United States Patent [19]

Hanson

[11] Patent Number: 4,926,606

[45] Date of Patent: May 22, 1990

[54] ORNAMENTAL CEILING SYSTEM

[76] Inventor: Carl E. Hanson, 666 Greenbrier, Crystal Lake, Ill. 60014

[21] Appl. No.: 271,229

[22] Filed: Nov. 14, 1988

[51] Int. Cl.[5] ..... E04B 5/52

[52] U.S. Cl. ..... 52/484; 52/489; 52/813; 52/463

[58] Field of Search ..... 52/484, 463, 486, 489, 52/495, 717, 716, 813, 311, DIG. 8

[56] References Cited

U.S. PATENT DOCUMENTS

| | | | |
|---|---|---|---|
| 2,389,171 | 11/1945 | Urbain | 52/484 X |
| 2,841,255 | 7/1958 | Kemp | 52/489 X |
| 3,208,119 | 9/1965 | Seckerson | 52/813 X |
| 3,277,624 | 10/1966 | Cornell | 52/484 |
| 3,312,028 | 4/1967 | Schroyer | 52/489 X |
| 3,387,872 | 6/1968 | Lovullo | 52/486 X |
| 3,415,018 | 12/1968 | Sutter | 52/484 X |
| 3,557,506 | 1/1971 | Pechenik | 52/484 X |
| 3,574,985 | 4/1971 | Pierce | 52/463 |
| 3,594,972 | 7/1971 | Jones | 52/495 X |
| 3,936,990 | 2/1976 | Garrison, Jr. | 52/717 |
| 3,969,865 | 7/1976 | Andersen | 52/489 X |
| 3,998,419 | 12/1976 | Semmerling | 52/484 X |
| 4,055,930 | 11/1977 | Weinar et al. | 52/717 |
| 4,084,364 | 4/1978 | Jones | 52/484 |
| 4,187,658 | 2/1980 | Reinwall, Jr. | 52/489 |
| 4,272,937 | 6/1981 | Brugman | 52/484 X |
| 4,317,418 | 3/1982 | Courshon, Jr. et al. | 52/489 X |
| 4,432,182 | 2/1984 | Addie et al. | 52/489 X |
| 4,452,021 | 6/1984 | Anderson | 52/484 X |
| 4,463,537 | 8/1984 | Rodriquez et al. | 52/484 X |
| 4,569,175 | 2/1986 | Abciuk | 52/484 |
| 4,720,946 | 1/1988 | Pagliarello | 52/484 X |
| 4,722,161 | 2/1988 | Young | 52/484 |
| 4,742,662 | 5/1988 | Smith | 52/489 X |

FOREIGN PATENT DOCUMENTS

| | | |
|---|---|---|
| 027196 | 4/1981 | European Pat. Off. . |
| 2509350 | 9/1975 | Fed. Rep. of Germany . |
| 3218989 | 12/1982 | Fed. Rep. of Germany . |

OTHER PUBLICATIONS

Innovative Ceiling System Brochure, Calif. (1987).

*Primary Examiner*—David A. Scherbel
*Assistant Examiner*—Creighton Smith
*Attorney, Agent, or Firm*—Karl G. Hanson

[57] ABSTRACT

An ornamental ceiling capable of attaching directly to an existing structural ceiling or to an existing suspended ceiling which uses inverted T-members as supports. The ornamental ceiling comprises a stile, an inverted T-member, a clip with a snap-on capability for readily attaching the stile to the inverted T-members, and an ornamental panel. A connector is provided for readily attaching the ornamental ceiling close to a preexisting structure ceiling. A hanger and a cantilever support is also disclosed for supporting a stile that longitudinally abuts a preexisting structural wall.

23 Claims, 7 Drawing Sheets

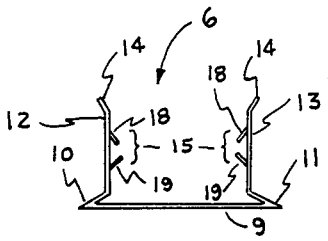
FIG. 2
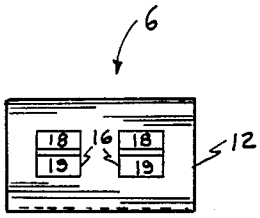
FIG. 3
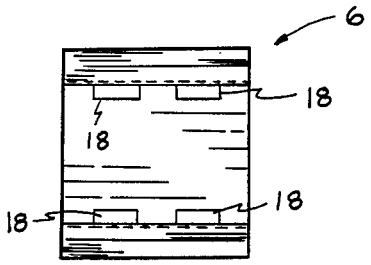
FIG. 4
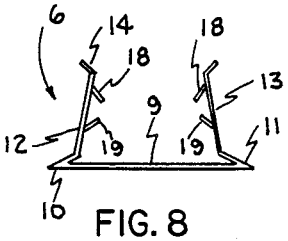
FIG. 8
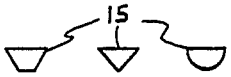
FIG. 7
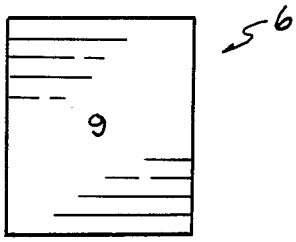
FIG. 5
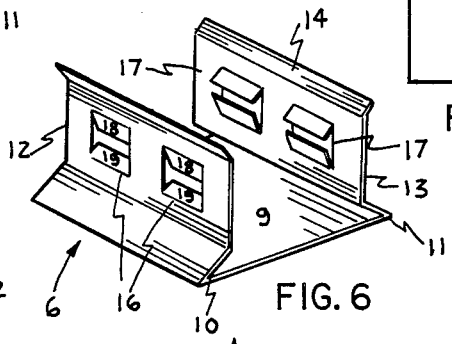
FIG. 6
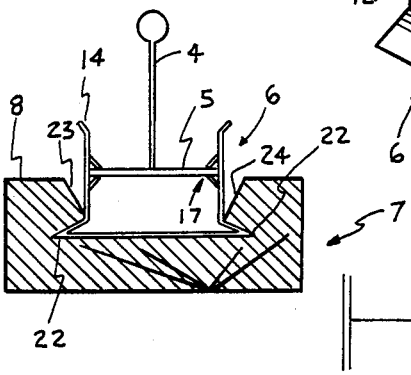
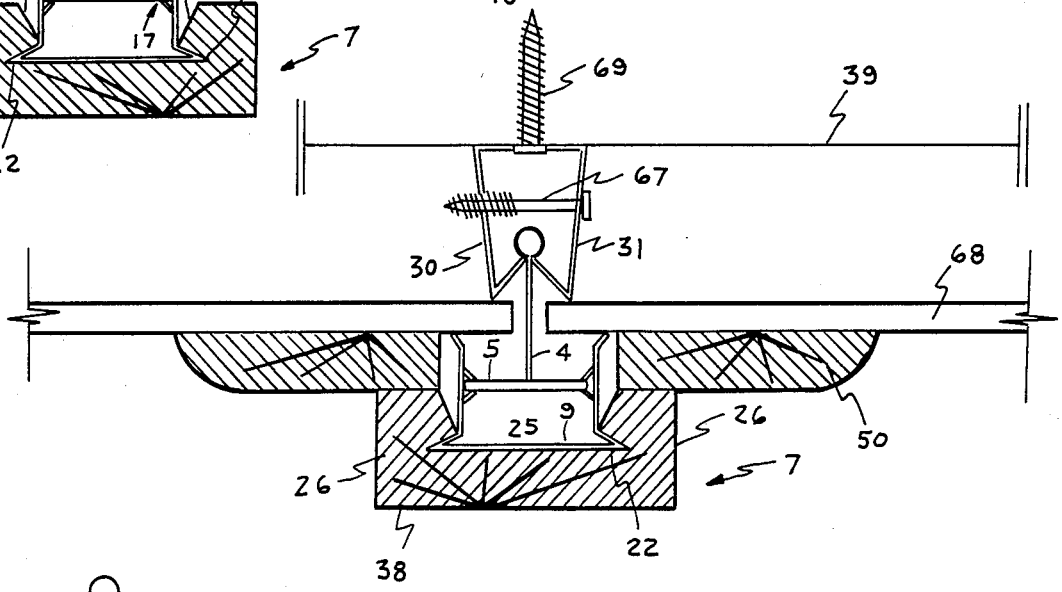
FIG. 10
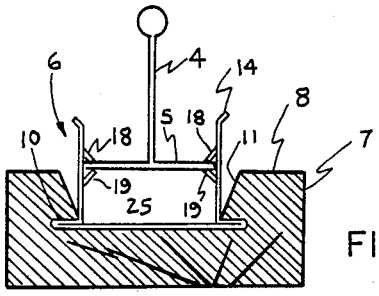
FIG. 11

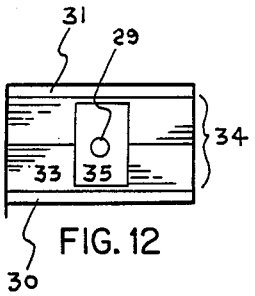
FIG. 12
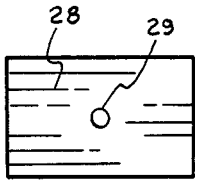
FIG. 13
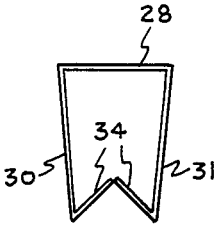
FIG. 14
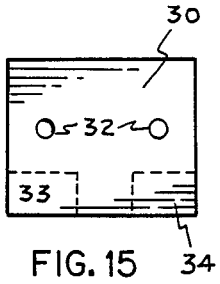
FIG. 15
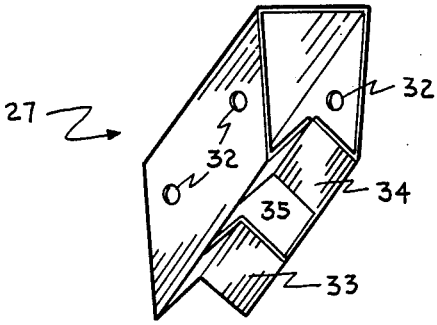
FIG. 17
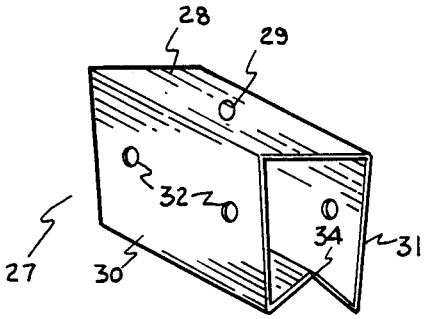
FIG. 16
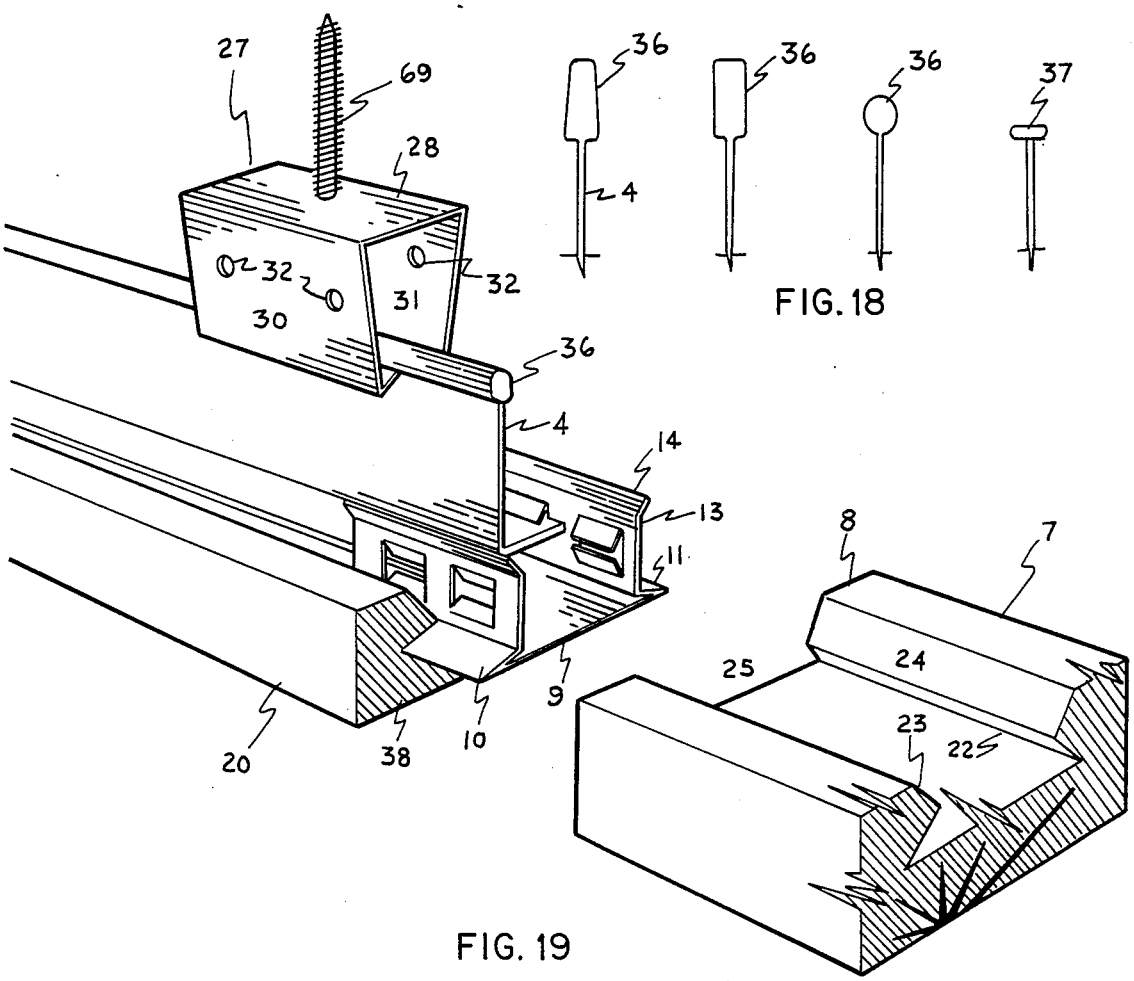
FIG. 18
FIG. 19

ORNAMENTAL CEILING SYSTEM

BACKGROUND OF THE INVENTION

This invention relates to decorative or ornamental ceilings which use conventional-type inverted T-members as supports, and more particularly this invention relates to an ornamental ceiling that readily, easily, and sturdily attaches to an existing suspended ceiling or to an existing structural ceiling.

Suspended ceilings are widely known and used in the ceiling construction art. The conventional suspended ceiling uses main and cross inverted T-members to from a grid for supporting 2'×2'or 2'×4' panels. The panels usually are white in color on their exposed surface and are made a fiber-type material. The main and cross inverted T-members are typically made from metal or plastic and are also painted white. The low cost and easy installation of these ceilings have promoted their wide-spread use.

Aesthetically, these conventional suspended ceilings have some drawbacks, however. When they are exposed to moisture, the ceiling's panels are left with a permanent stain that resembles a coffee stain on a white shirt. Moreover, the panel's fiber construction has a rather cheap appearance and is easily fractured. The exposed metal inverted T-members do not improve the ceiling's appearance either. Painted metal by its nature is somewhat unattractive, especially when compared with a beautiful woodgrain structure. To improve the unsightly appearance of conventional suspended ceilings, inventors have developed certain types of fasteners, stiles, and moldings that are used to cover or hide the exposed portion of the main and cross inverted T-members. The unattractive conventional suspended ceiling panel, also, is usually replaced with a decorative one. Examples of such developments in the art are seen in U.S. Pat. Nos.: 4,742,662, 4,722,161, 4,569,175, 4,452,021, 3,936,990, 3,594,972, 3,557,506, 3,387,872; DE Pat. No. 3218989 A1; and European Pat. No. 0027196. While these disclosures do show certain systems for enhancing the appearance of a suspended ceiling by covering an inverted T-member with a stile, they do have some shortcomings.

For example, U.S. Pat. Nos. 4,742,662, 4,722,161, 4,452,021, 3,594,972; FRG Pat. No. 3218989 A1; and E.P. No. 0027196 attach a horizontal portion of the inverted main and cross T-members to the ornamental main and cross stiles below the main and cross stiles' upper face. That is, the horizontal portion of the inverted T-member resides within the stile and not above the stile. This poses problems.

For one, it requires notching out the main stile at every intersection with a cross stile so that the main and cross inverted T-members can engage each other.

For two, it requires that the stiles more closely follow the same lengthwise or longitudinal path as the inverted T-members. This can be very difficult to accomplish, especially if the main stile is made from wood which naturally has a crown or, if the main stile is relatively long and has been exposed to temperature and humidity fluctuations or rough handling that would cause it to twist or curve.

The above-noted problem of having the main stile closely follow the same longitudinal path as the inverted T-member(s) may still be encountered where the horizontal portion of the inverted T-member is attached above the upper face of the stile. For example, if a clip is used to fasten the stile to the inverted T-member, and the clip is not provided with a certain degree of play, the stile will still have to closely follow the longitudinal path of the inverted T-member.

Another deficiency in the ar is the required manipulation of the stile or clip, if used, which secures the stile to the inverted T-member. For example, in U.S. Pat. No. 3,594,972 the stile must be cocked along its whole length to get it to engage in existing T-member, and in U.S. Pat. No. 4,569,175 each clip must be pulled open by the user to permit the clips to engage the horizontal portion of the inverted T-member.

Problems may also be encountered by the user when attempting to install a decorative suspended ceiling in an area that has a low existing ceiling. Many housing codes provide that the floor to ceiling height be 8'. The conventional height of existing ceilings in homes today is also around 8'. Thus to keep within the housing codes, the ornamental ceiling must be capable of fastening directly to the ceiling within a minimum number of inches. Conventional suspended ceilings use wire to support the inverted T-members. The wire, however, is very difficult to tie within a tight area and it does not statically hold the T-member in place so that the stile can be readily and easily attached to the T-member.

Thus, a primary object of the present invention is to provide a new and improved ornamental ceiling which overcomes the shortcomings of the prior art.

SUMMARY OF THE INVENTION

The above-noted shortcomings and deficiencies in the art are overcome by providing a complete ornamental ceiling system that uses inverted T-member, ornamental panels, stiles, clips for readily fastening the stiles to the inverted T-members, hangers for supporting the stile near a preexisting structural wall, and connectors and cantilever supports for supporting the ornamental ceiling close to a preexisting ceiling.

The inverted T-members used in this invention are the conventional main and cross inverted T-members on the market today. These T-members have a generally horizontal portion (laterally extending flanges), a generally vertical portion, and a knob located at the upper end of the vertical portion. The inverted cross T-members engage the main T-members to form a grid network of 2'×2' or 2'×4' squares.

When using this invention to connect to an existing suspended ceiling, the inverted T-member grid is already assembled and suspended. Thus, only the stile, clip, hanger, and panel are needed.

The stile, like the inverted T-members, comes in two sizes: main stiles and cross stiles. The difference between the main and cross stiles is their length. They have similar cross-sectional patterns which comprise a groove located centrally and longitudinally along the stiles upper surface. Within this longitudinal groove is a means for engaging the clip and first and second side walls that extend upwardly and outwardly from the clip engaging means to the upper face of the stile.

The clip is a fastener having a snap-on capability for readily and sturdily securing the main and cross stiles to the main and cross inverted T-members, but not necessarily in that order. In its preferred embodiment, the clip has a bottom surface, first and second stile engaging means, first and second side walls, tines projecting inwardly from the sidewalls, and guiding flanges extending outwardly from the top of the sidewalls. The flanges are provided for guiding the horizontal portion of the inverted T-member into the clip. The sidewalls of the clip are resiliently attached to the clip so that they can easily expand when the inverted T-member is inserted into, or removed from, the clip. The flexibility of the sidewalls also allows the clip to compensate for any differences in longitudinal alignment between the stile and the inverted T-member.

Hangers are provided for supporting a stile that longitudinally abuts a preexisting wall. In its preferred embodiment, the hanger has a vertical surface, a horizontal surface, and a stile engaging portion that has a shape which corresponds to the shape of the clip engaging means in the stile. The vertical surface and the horizontal surface of the hanger, preferably, are at an acute angle so that the stile remains flush with the panel that lies above it. The hanger would normally rest upon a conventional L-shaped angle member that would be attached to the wall.

If the ornamental ceiling should be attached close to a preexisting structural ceiling, a connector is provided for readily and sturdily supporting the inverted T-member grid system. The connector, in its preferred embodiment, has a top surface with a hole located therein for directly securing the connector to a preexisting ceiling. First and second sidewalls extend downwardly and inwardly from the top surface. Two sets of teeth are attached at the lower ends of the sidewalls and are separated in the longitudinal direction by a gap. The gap allows access to the hole located in the top surface to permit fastening the connector to the existing ceiling. The teeth are resiliently attached to the sidewalls and the sidewalls are resiliently attached to the top surface, thus allowing the inverted T-member to be readily snapped in place. Opposing holes are located symmetrically from each other in the sidewalls so that a fastener, such as a bolt, may pass therethrough to draw the sidewalls towards each other to further secure the inverted T-member between the connector's teeth.

The stile is supported close to preexisting structural ceiling along a preexisting wall by using either the hanger and the L-shaped angle member or the connector and a cantilever support. Either combination may be employed, however, the hanger and the L-shaped angle member is preferred as it is a simpler means.

Accordingly, an object of the present invention is to provide a new and improved ornamental ceiling. It is another object of the invention to provide a clip that has a snap-on capability for readily and sturdily securing the clip to a horizontal portion of an inverted T-member.

It is another object of the invention to provide a connector that attaches directly to a preexisting ceiling and also has a snap-on capability for readily and sturdily supporting the vertical portion of an inverted T-member.

It is a further object of the invention to provide a hanger for supporting a wall-abutting stile s that the stile will remain flush with the adjacent panel.

A still further object of the invention is to provide clips, connectors, hangers, and supports of simple design.

It is still a further object of the invention to provide an ornamental ceiling that can be easily installed and removed.

Another object of the invention is to provide a ceiling system which improves the appearance of a conventional suspended ceiling.

The above and further objects and novel features of the invention will more fully appear from the following detailed description and accompanying drawings. Like reference numerals are used in the drawings to designate the same parts illustrated in different figures. It is to be expressly understood, however, that the drawings and written description are for the purpose of illustration only and are not intended as a limiting definition of the invention.

DETAILED DESCRIPTION OF THE DRAWINGS

FIG. 2 is an end view of a preferred embodiment of a clip in accordance with the present invention;

FIG. 3 is a side view of a preferred embodiment of a clip in accordance with the present invention;

FIG. 4 is a top view of a preferred embodiment of a clip in accordance with the present invention;

FIG. 5 is a bottom view of a preferred embodiment of a clip in accordance with the present invention;

FIG. 6 is perspective view of a preferred embodiment of a clip in accordance with the present invention;

FIG. 7 shows various alternative shapes for tines on a clip in accordance with the present invention;

FIG. 8 is an end view of a clip in accordance with the present invention; having inwardly angling sidewalls;

FIG. 9 is a sectional view of a clip, in accordance with the present invention, in engagement with a stile and an inverted T-member;

FIG. 10 is a sectional view of a preferred embodiment of a ceiling in accordance with the present invention taken along line 2—2 of FIG. 1 showing a suspended ceiling in accordance with the present invention attached to a preexisting ceiling;

FIG. 11 is a cross-sectional view of a preferred embodiment of a clip in accordance with the present invention in engagement with a stile;

FIG. 12 is a bottom view of a preferred embodiment of a connector in accordance with the present invention;

FIG. 13 is a top view of a preferred embodiment of a connector in accordance with the present invention;

FIG. 14 is an end view of a preferred embodiment of a connector in accordance with the present invention;

FIG. 15 is a side view of a preferred embodiment of a connector in accordance with the present invention;

FIG. 16 is a first perspective view of a preferred embodiment of a connector in accordance with the present invention;

FIG. 17 is a second perspective view of a preferred embodiment of a connector in accordance with the present invention;

FIG. 18 shows of knobs in accordance with the present invention located on the vertical portion of the inverted T-member;

FIG. 19 is a perspective view of a preferred embodiment of a ceiling in accordance with the present invention showing abutting stiles supported by a single clip;

DETAILED DESCRIPTION OF THE INVENTION

Figure 1:
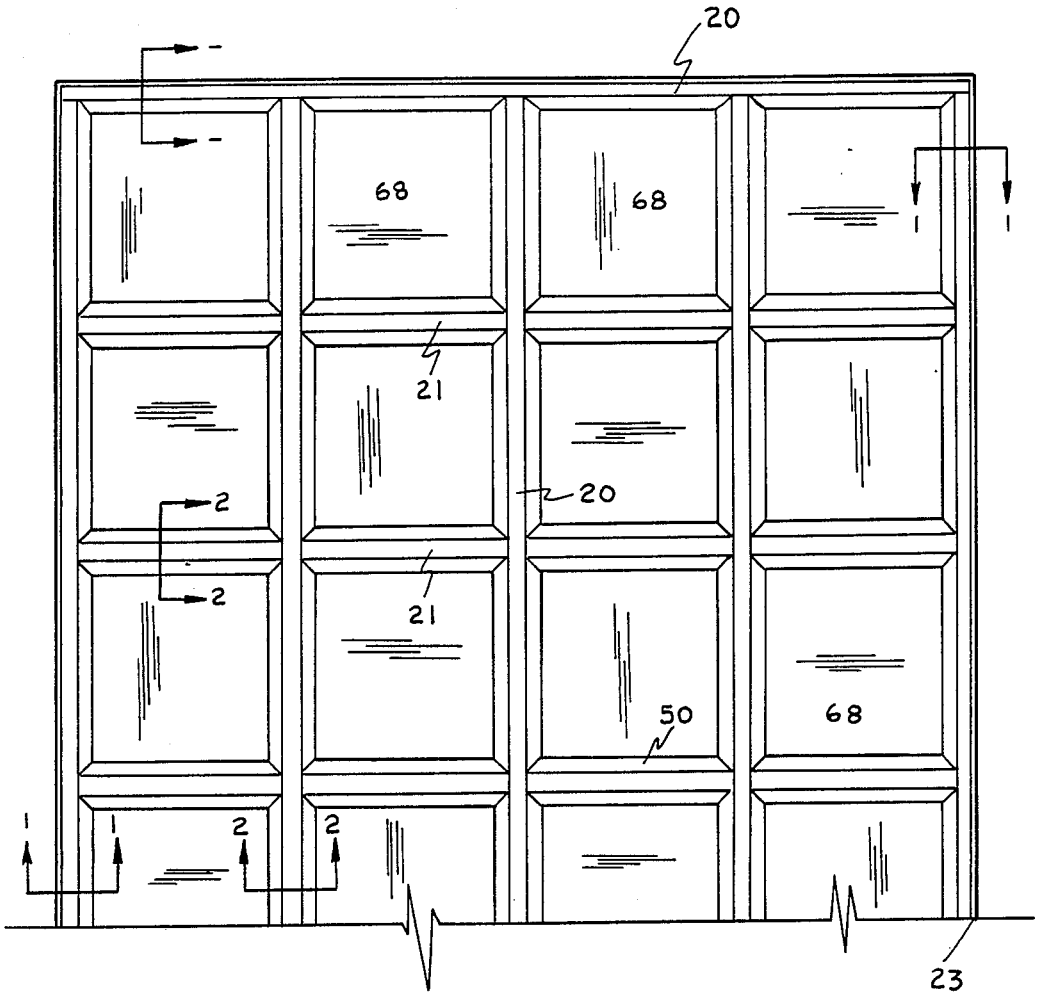
FIG. 1 is a plan view of a preferred embodiment of an ornamental ceiling in accordance with the present invention showing the exposed surfaces of the stiles, moldings and panels.

In describing the preferred embodiment of the subject invention illustrated in the drawings, specific terminology will be resorted to for the sake of clarity. However, the invention is not intended to be limited to the specific terms so selected, and it is to be understood that each specific term includes all the technical equivalents which operate in a similar manner to accomplish a similar purpose.

Figure 22:
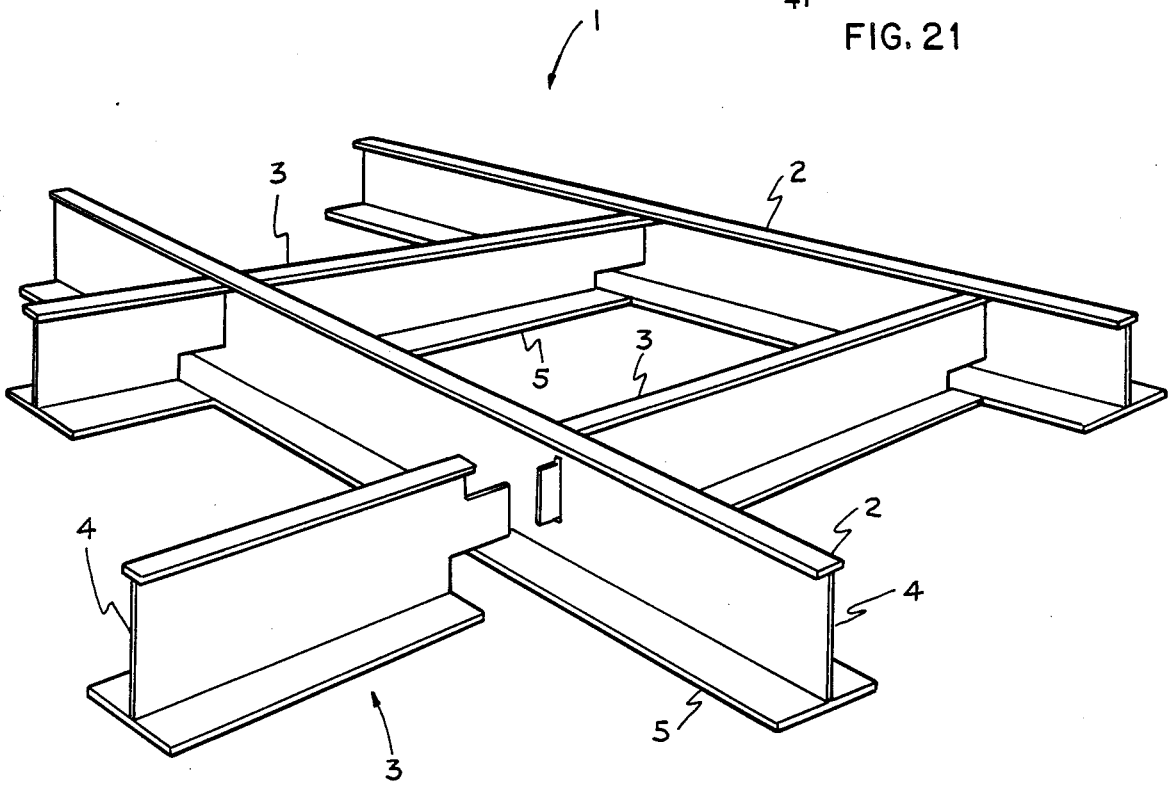
FIG. 22 shows main and cross inverted T-members in accordance with the present invention forming a grid.

Referring first to FIG. 22, a conventional inverted T-grid structure 1 is shown. The grid 1 comprises main inverted members 2 and cross inverted T-members 3. This inverted T-grid system 1 forms a basic structure for the invention. The T-grid 1 is used when the ornamental ceiling is attached directly to a pre-existing structural ceiling or when the ornamental ceiling of this invention is suspended from an existing ceiling. As it may be seen in FIG. 22 and other figures where designated, the main and cross inverted T-members 2 and 3 have a generally vertical portion 4 and a generally horizontal portion 5.

Turning now to FIGS. 2 through 20, a preferred embodiment of the clip 6 is shown. The clip 6 is slidably positioned in a stile 7 and is for attaching the stile 7 to the horizontal portion 5 of the inverted T-members 2 and 3. It should be noted, as can be best seen in FIGS. 9, 10, 11, 20, 25 and 27 that the horizontal portion 5 of the inverted T-member 2 or 3 attaches to the clip 6 above the upper face 8 of the stile 7. By having the horizontal portion 5 of the inverted T-member 2 or 3 connect to the stile 7 in such a fashion, the stiles do not have to notched out at every juncture. That is, if the horizontal portion 5 of the inverted T-member 2 or 3 were attached to the clip below the upper face 8 of the stile 7, the stile 7 would have to be notched out so that the main runners 2 and the cross members 3 of the grid 1 could properly intersect at each junction.

Referring more precisely to FIGS. 2–6 the clip 6, it will be noticed, has a bottom surface 9, first 10 and second 11 stile engaging means, a first sidewall 12 and a second sidewall 13, guiding flanges 14 and tines 15. The side walls 12 and 13 have a resilient capability that allow side walls 12 and 13 to expand outwardly in response to a force from the horizontal portion 5 of the inverted T-member 2 or 3. The resiliency of side walls 12 and 13 further permits side walls 12 and 13 to contract inwardly for instantaneous engagement of the inverted T-member's horizontal portion 5.

In FIGS. 3 and 6 it can be best seen that there are two sets of tines. A first set 16 extends inwardly from the first sidewall 12 and a second set 17 extends inwardly from the second sidewall 13. Each set of tines 16 and 17 comprises two pairs of tines. Each pair of tines is separated longitudinally so that abutting inverted T-members can be attached to a single clip as seen in FIG. 19. However, it will not always be the case that inverted T-member 2 will end at the same place as main stile 20. It may be also see in FIGS. 3 and 6 that each set of tines 16 and 17 has an upper tine 18 and a lower tine 19. The upper tine 18 and lower tine 19 of the clip point substantially toward the same area to form a apex. These tines have a resilient capacity in the up and down direction and are at angles acute from a plane which lies between the upper tine 18 and the lower tine 19 and parallel to the respective sidewall 12 or 13. The clip's tines 15 do not have to be rectangular in shape; they may take on shapes such as those in FIG. 7.

As can be seen in FIGS. 9, 10, 11, 20, 25 and 27, the inverted T-member's horizontal portion 5 can readily engage the clip 6 because the tines 15 in conjunction with the side wall resilient capability with a snap-on ability. Additionally, the guiding flanges 14 make it easier for the user to install the inverted T-member 2 or 3 into the clip 6 when, for example, the inverted T-member's horizontal portion 5 cannot be seen because the stile 7 is in the installers line of sight. This would be the case when the inverted T-grid is already in place above the head of the installer.

Turning now to FIGS. 1, 9, 10, 11 and 19 a construction of a stile 7 will be described. As seen in FIG. 1 there are main stiles 20 and cross stiles 21. The main stiles 20 and the cross stiles 21 each have a longitudinal groove generally centrally disposed along the upper surface 8 of the stile 20 and 21. As seen in FIGS. 9, 10, 11, 19, 20, 23, 25 and 27, the stile 7 (20 and 21) has a clip engaging means 22 and sidewalls 23 and 24 that extend upwardly and outwardly from the interior of the stile's groove 25. This gives the sidewalls 12 and 13 of the clip 6 some play so that they can easily expand for engaging or disengaging the horizontal portion 5 of the inverted T-member, or so that sidewalls 12 and 13 may have some latitude in the event the stile 7 and the inverted T-members 2 and 3 do not follow each other perfectly along the same longitudinal line. Thus, to get the clip 6 to engage the T-member's horizontal portion 5 all the installer needs to do is place the clip's guiding flanges in proper alignment with the T-member's horizontal portion 5 and push the clip 6 and T-member 2 or 3 into engagement.

Turning now to FIGS. 10 and 12–19 a preferred embodiment of a connector 27 will be seen. The connector 27 is for attaching the ornamental ceiling directly to a preexisting structural ceiling with a minimum of clearance and effort. Connector 27 has a top surface 28 with a hole 29 located therein. Hole 29 allows the connector 27 to be directly fastened to a preexisting structural ceiling. Sidewalls 30 and 31 are resiliently attached to the top surface 28 and extend downwardly from the same. Sidewalls 30 and 31 have a resilient capacity which allows them to readily expand outwardly and contract inwardly. In each sidewall 30 and 31 there is placed holes 32; the holes on sidewall 30 symmetrically oppose the holes on sidewall 31. Attached to the sidewalls 32 and 33 are two sets of teeth 33 and 34 which extend upwardly towards the top surface 28. Teeth 33 and 34 resiliently open and close for instantaneous engagement of the main T-member's vertical portion 4. The first set of teeth 33 is longitudinally separated from the second set of teeth 34 to define a gap 35 between the teeth that provide access to the hole 29 on the top surface 28 of the connector 27. As can be seen in FIGS. 19, 20, 25 and 27, the upper end of the vertical portion 4 of the main inverted T-member 2 is secured by the teeth of the connector 27. The teeth in both the first and second sets 33 and 34 are resiliently expanded outwardly or opened when the upper end or knob 36 of the inverted T-member is pushed therethrough. That is, the knob 36 of the T-members vertical portion 4 pushes each tooth towards its sidewall; the sidewall also is pushed outwardly by the upward vertical force of the T-member's knob 36, allowing instantaneous engagement of the T-member's vertical portion 4 to the connector 27. Thus, the teeth have a snap on capability for readily engaging the upper end 36 of the T-member 2. It should be noted that the connector 27 would only engage the main T-member 2 and not the cross T-members 3, because the cross T-members 3 rest on the main T-members 2, shown as in FIG. 22. Also, when installing the connectors to a preexisting ceiling one would be best advised to have the main T-members 2 run perpendicular to the floor or ceiling joist so that the connector 27 may be screwed directly to the joist by means of a screw 69 extending through the hole 29 on the top surface 28. The holes 32 in the sidewalls of the connector 27 serve two purposes. First, they allow a fastener 67 to pass through the symmetrically opposed holes to act as a barrier that would prevent the T-member being forced upwardly when the clip 6 is attached to the T-member's horizontal portion 5. Second, the holes 32 permit the fastener 67 to draw the first sidewall 30 toward the second sidewall 31 to provide extra biting power for the teeth.

Figure 20:
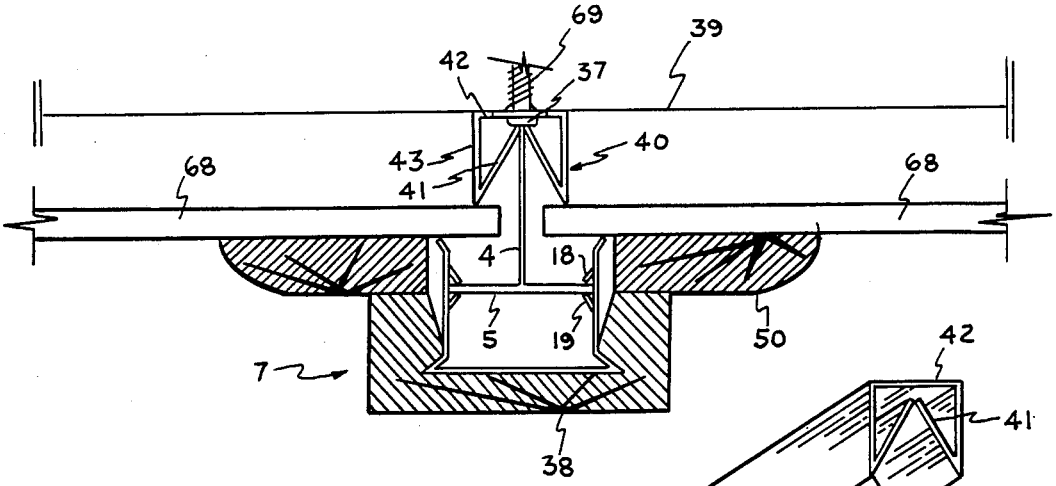
FIG. 20 is a sectional view taken along line 2—2 of FIG. 1 showing a shortened connector in accordance with the present invention which more closely secures the T-member to a preexisting ceiling.
Figure 21:
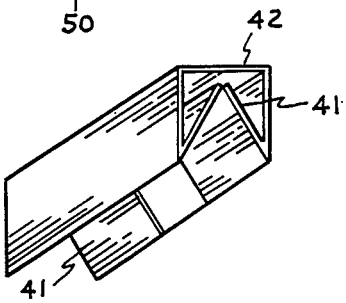
FIG. 21 shows a perspective view of a shortened connector.

As it can be seen in FIG. 18, the upper end 36 of the T-member comes in various shapes. The connector of FIGS. 12–16 can readily engage any one of these types of knobs 36 or 37. If, however, a minimum distance is required between the bottom surface 38 of the stile 7 and the existing structural ceiling 39 a connector 40 as seen in FIGS. 20 and 21 may be used. As it can be seen the connector 40 has teeth 41 that extend upwardly very close to the top surface 42 of the connector 40. Thus, for a minimum distance between the bottom surface 38 of the stile 7, a clip 40 having teeth 41 and shortened sidewalls 43 would be used in conjunction with the inverted T-member having a knob 37.

Figure 23:
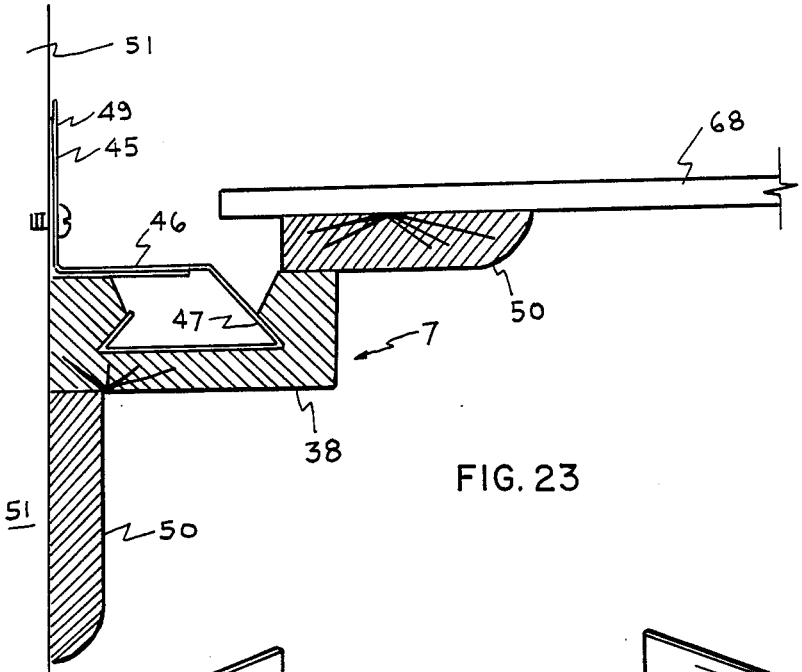
FIG. 23 is a sectional view taken along line 1—1 of FIG. 1 showing a hanger, in accordance with the present invention, supporting a stile abutting a preexisting wall.
Figure 24:
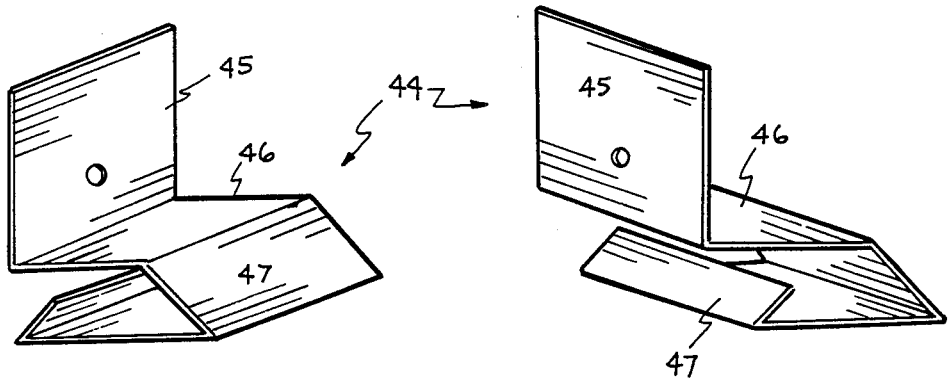
FIG. 24 shows left and right perspective views of the hanger in accordance with the present invention.

Turning now to FIGS. 23 and 24, the hanger 44 of the present invention is seen. The Hanger 44 supports the stile 7 along a preexisting structural wall 51. The hanger 44 has a vertical portion 45, a horizontal portion 46, and a stile engaging portion 47. In the preferred embodiment the horizontal portion is at an acute angle with the vertical portion 45 when the hanger is not in use. This provision keeps the stile 7 flush with the ornamental panel 68 when the hanger is in use. As it can be seen in FIG. 23, the vertical portion 45 and the horizontal portion 46 of the hanger rest adjacently upon an L-shaped angle member 49. To provide further support to the stile 7 when it abuts a preexisting wall 51, a molding 50 may be attached to the wall 51 just below the bottom surface 38 of the stile 7. The molding 50 may also be used to provide further enhancement of the beauty of the ornamental ceiling as seen in FIGS. 1, 10, 20, 23, 27, and 28.

Figure 25:
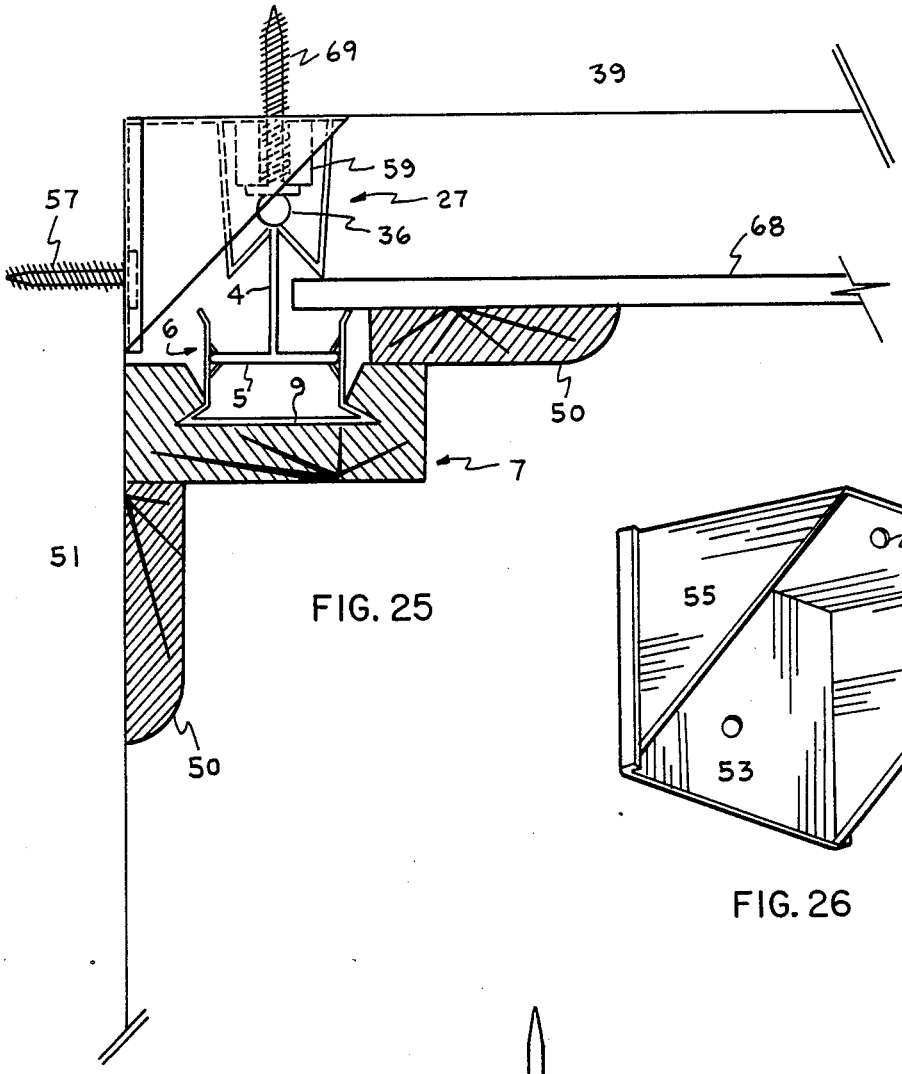
FIG. 25 shows a sectional view taken along line 1—1 of FIG. 1 showing a cantilever support in accordance with the present invention for supporting a stile abutting a preexisting wall.
Figure 26:
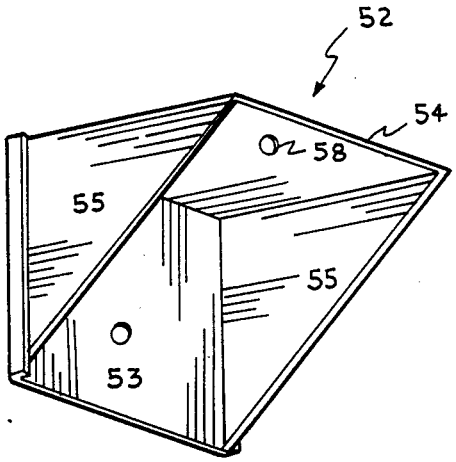
FIG. 26 is a perspective view of a cantilever support in accordance with the present invention.

In FIGS. 25 and 26 an alternative means for attaching the stile 7 longitudinally along a preexisting wall 51 may be seen. In this embodiment, the connector 27 or 40 would be used in conjunction with the cantilever support 52 and the clip 6. The clip 6 is attached to the stile in the usual manner and the connector attaches to the upper end of the T-member 36 or 37 as discussed above. However, where the ceiling 39 meets the wall 51 there usually is not a joist for the connector 27 or 40 to attach to. Thus, when using the connector 27 to support the stile 7 abutting an existing ceiling, the cantilever support 52 is needed. The cantilever support 52 has a vertical surface 53, a horizontal surface 54 and side surfaces 55. The vertical surface 53 has a hole 56 located therein so that a fastening means such as a wood screw 57 may be used to engage the upper plate of the wall. The hole 58 in the horizontal surface, however, should be threaded because, usually, there will not be a stud for the screw 69 to engage. Thus, the screw 69 would have threads sized to engage the threads in hole 58.

Figure 27:
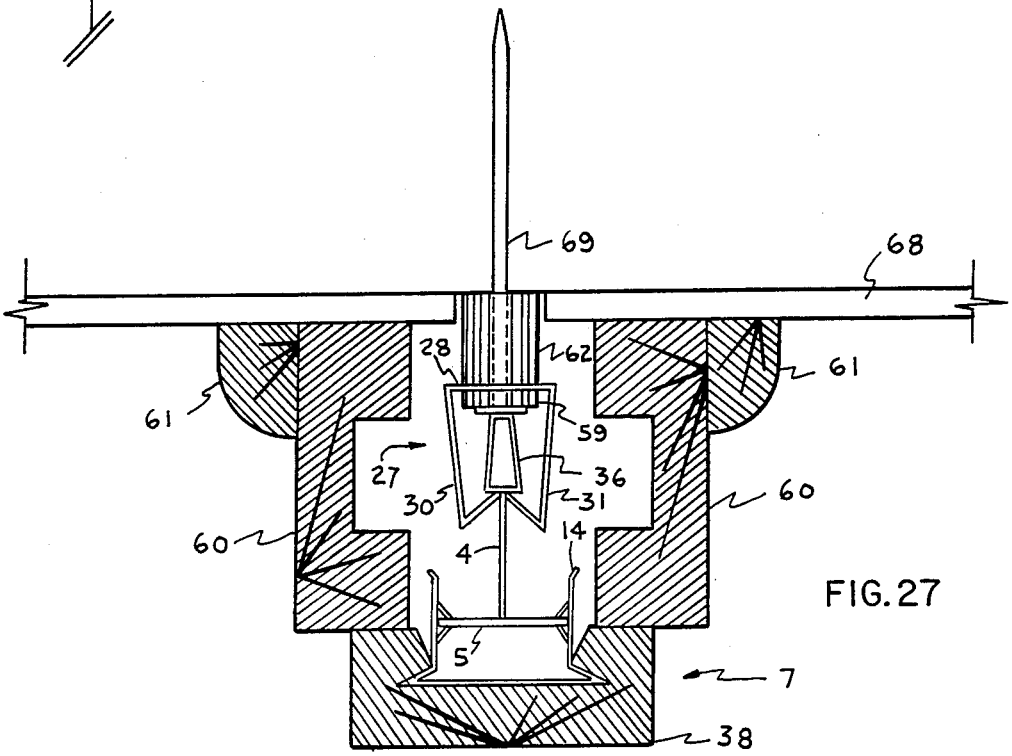
FIG. 27 is an alternative embodiment of a ceiling in accordance with the present invention showing the use of different moldings to enhance the appearance of the invention.

In FIGS. 25 and 27, it will be seen that spacers 59, such as washers, may be used to shorten the distance between the fastening means 69 and the upper end of the T-member 36. Using spacers 59 in such a fashion prevents the ceiling from floating. That is, after the ceiling is installed, one would not be able to push the ceiling up from the bottom surface 38 of the stile.

Looking particularly at FIG. 27, it is seen that stiles 60 may be turned on their ends and used as moldings to further enhance the ornamentation of ceiling. Additionally, base cap 61 may also be used to further ornament the ceiling. Under such circumstances, however, it would probably necessary to insert spacers 62 between the top surface 28 of the connector 27 and the existing ceiling to allow for the additional vertical distance.

Figure 28:
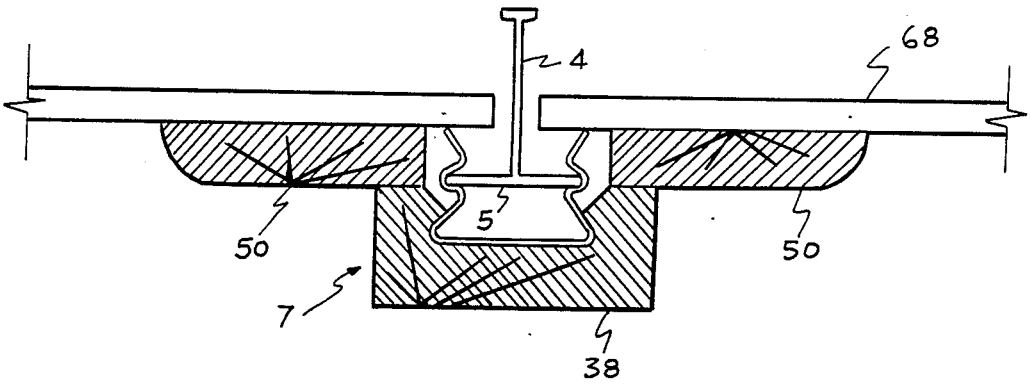
FIG. 28 is a sectional view of an embodiment of a clip in accordance with the present invention taken along line 2—2 of FIG. 1.
Figure 29:
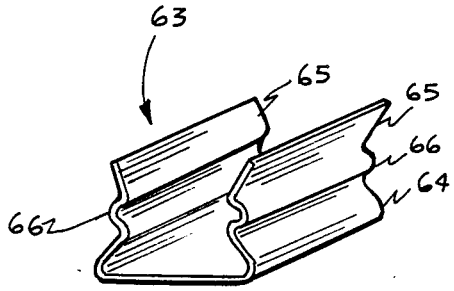
FIG. 29 is a perspective view of an embodiment for a clip in accordance with the present invention.

Examining FIGS. 28 and 29 an alternative embodiment of the clip is seen. Clip 63 has a stile engaging means 64, a guiding flange 65 and symmetrically opposed channels 66 for engaging the horizontal portion of the inverted T-member 5. Like the preferred embodiment 6, the alternative embodiment of the clip 63 is slidably positioned within a longitudinal groove 25 of the stile 7. Clip 63 also has side walls that resiliently expand outwardly and contract inwardly for quick engagement and disengagement of an inverted T-member. Likewise, the channels 66, for engaging the horizontal portion 5 of the inverted T-member, are spaced from the means for engaging the stile 64 so that the horizontal portion of the inverted T-member engage the clip 63 above the upper face 8 of the stile 7. From the above it is apparent that many modifications and variations of the present invention are possible in light of the above teachings. Thus, it is intended that the present invention cover modifications and variations of this invention provided they come within the scope of the appending claims and there equivalents.

I claim:

1. An ornamental ceiling that attaches close to a preexisting structural ceiling, comprising:

(a) an inverted T-member having a generally vertical portion and a generally horizontal portion;

(b) a stile having an upper face, a lower face and a longitudinal groove generally centrally disposed along the upper face of the said stile;

(c) a clip associated with said longitudinal groove having a means for attaching said clip to the horizontal portion of said inverted T-member, wherein the horizontal portion of said inverted T-member is located above the upper face of said stile;

(d) a panel located above the lower face of said stile and laterally from the vertical portion of said inverted T-member; and (e) a connecter attached to an upper end of the generally vertical portion of said inverted T-member and having a resilient snap-on means for readily gripping the upper end of the generally vertical portion of said inverted T-member and a means for securing the connector directly to a preexisting structural ceiling so that the distance between the lower face of stile and the preexisting structural ceiling may be less than six inches.

2. The ornamental ceiling of claim 1 wherein the longitudinal groove of said stile has planar sidewalls that angle outwardly from the interior of said groove towards the upper surface of said stile to permit the first and second side surfaces of said clip to resiliently expand when the horizontal portion of said inverted T-member is inserted therein.

3. The ornamental ceiling of claim 2, further comprising a hanger and an L-shaped angle member for supporting a stile that longitudinally abuts a preexisting wall, said L-shaped angle member attached to a preexisting wall and said hanger having a generally vertical surface, a generally horizontal surface that forms an acute angel with said vertical surface when said hanger is not in use, and a stile engaging portion that has a cross-sectional shape corresponding to a cross-sectional shape in said longitudinal groove of said stile, wherein said generally vertical and horizontal portions of said hanger reside above and adjacent to said L-shaped angle member and said stile engaging portion is located within said groove of said stile.

4. The ornamental ceiling of claim 3 further comprising a molding located below and adjacent to a stile that longitudinally abuts a preexisting structural wall, and said molding attached to said wall providing further support to said stile.

5. The ornamental ceiling of claim 1, further comprising a hanger and an L-shaped angle member for supporting said stile near a preexisting wall, said L-shaped member attached to the preexisting wall and said hanger having a generally vertical surface, a generally horizontal surface that forms an acute angel with said vertical surface when said hanger is not in use, and a stile engaging portion that has a cross-sectional shape corresponding to a cross-sectional shape in said longitudinal groove of said stile, wherein said generally vertical and horizontal portions of said hanger reside above and adjacent to said L-shaped angle member and said stile engaging portion is located within said groove of the stile.

6. The ornamental ceiling of claim 5 further comprising a molding located below and adjacent to the stile, wherein said stile longitudinally abuts the wall of the preexisting structure, and said molding is attached to said wall to provide further support to said stile.

7. The ornamental ceiling of claim 1, further comprising a cantilever support which has a vertical portion with a hole located therein so that said cantilever support may be secured directly to a preexisting structural wall that abuts the preexisting structural ceiling, said cantilever support also having a horizontal portion that has a threaded hole therein for engaging a threaded means for securing said connector to the ceiling.

8. The ornamental ceiling of claim 1, wherein said clip comprises:

(a) a bottom surface;

(b) means for engaging said stile associated with said bottom surface of said stile;

(c) first and second side surfaces resiliently associated with said bottom surface; and (d) inverted T-member engaging means associated with said side surfaces for instantaneously engaging the generally horizontal portion of said inverted T-member, wherein said side surfaces expand outwardly when a force is applied from said T-member's generally horizontal portion and then contract inwardly to engage the generally horizontal portion of said inverted T-member.

9. The ornamental ceiling of claim 8 wherein said T-member engaging means comprises first and second sets of tines projecting inwardly from first and second side surfaces respectfully having a resilient capability for readily engaging the horizontal portion of said inverted T-member, wherein said first and second set of tines are distanced from said stile engaging means so that the tines may engage the horizontal portion of said inverted T-member above the stile.

10. The ornamental ceiling of claim 1, wherein said connector further comprises:

(a) a top surface having a means for attaching said connector directly to said preexisting structural ceiling;

(b) first and second opposing sidewalls extending from said top surface; and (c) teeth connected to said sidewalls and extending upwardly toward said top surface of said connector, wherein said teeth resiliently open in response to a force from the knob of said inverted T-member and subsequently close for instantaneous engagement of said inverted T-member's generally vertical portion.

11. An ornamental ceiling that can be readily attached to a preexisting suspended ceiling which uses inverted T-members and L-shaped angle members to support panels, said ornamental ceiling comprising:

(a) a stile having an upper face, a lower face and a longitudinal groove generally centrally disposed along the upper face of said stile;

(b) a clip that attaches to said stile and horizontal portion of an inverted T-member for supporting said stile from the inverted T-member, said clip comprising:

a bottom surface;

first and second means for engaging said stile associated with said bottom surface;

first and second side surfaces resiliently associated with said bottom surface;

inverted T-member engaging means associated with said side surfaces for instantaneous engagement of the generally horizontal portion of said inverted T-member, wherein said side surfaces resiliently expand outwardly in response to a force from said T-member's generally horizontal portion and contract inwardly to engage the generally horizontal portion of said inverted T-member; and (c) an ornamental panel located above the lower face of said stile and laterally from a vertical portion of said inverted T-member.

12. The ornamental ceiling of claim 11, wherein said clip has first and second sets of tines projecting inwardly from said first and second side surfaces respectively, each set of tines having an upper tine and a lower tine, wherein said upper and lower tines are each at acute angles from a plane that lies between said upper and lower tines parallel to the respective side surface, for easily and sturdily engaging the horizontal portion of an inverted T-member, wherein said first and second sets of tines are distanced from said stile engaging means so that the tines may engage the horizontal portion of said inverted T-member above the upper face of said stile.

13. The ornamental ceiling of claim 11, further comprising a hanger for supporting said stile where said stile longitudinally abuts a preexisting structural wall, said hanger comprising a generally vertical surface, a generally horizontal surface that forms an acute angle with said vertical surface when said hanger is not in use and a stile engaging portion extending from said generally horizontal surface, said stile engaging portion having a shape corresponding to a longitudinal shape in the longitudinal groove of said stile.

14. The ornamental ceiling of claim 13, wherein said clip has means for guiding the horizontal portion of the inverted T-member between the first and second side surfaces of the clip so that the horizontal portion of the inverted T-member can be more easily attached to the clip.

15. A clip for supporting a stile on an ornamental ceiling and capable of attaching to a horizontal portion of an inverted T-member, comprising:

(a) a bottom surface,
(b) means for engaging the stile said means associated with said bottom surface;
(c) first and second side surfaces resiliently associated with said bottom surface the side surfaces having an inverted T-member engaging means for instantaneously engaging a generally horizontal portion on said inverted T-member, wherein said side surfaces expand outwardly in response to a force from said T-member's generally horizontal portion and contract inwardly to instantaneously engage said T-members generally horizontal portion.

16. A clip for attaching a stile to the generally horizontal portion of an inverted T-member, comprising:

(a) a bottom surface;
(b) a stile engaging means associated with the bottom surface;
(c) first and second side surfaces extending from the bottom surface;
(d) resilient means associated with the side surfaces for allowing the side surfaces to expand outwardly and contract inwardly;
(e) responsive means integral with the side surfaces responsive to a force from a generally horizontal portions of the inverted T-member for expanding the side surfaces outwardly; and
(f) inverted T-member engaging means associated with the first and second side surfaces for engaging the generally horizontal portion of the inverted T-member, wherein the inverted T-member engaging means has firs: and second sets of tines projecting inwardly from the first and second side surfaces respectively, each set of tines having an upper tine and a lower tine, wherein the upper and lower tines are each at acute angles from said side surfaces, to provide quick and sturdy engagement with the generally horizontal portion of the inverted T-member.

17. The clip of claim 16, wherein the first and second sets of tines are distanced from the stile engaging means so that the tines engage the horizontal portion of the inverted T-member above the upper face of the stile.

18. The clip of claim 17 further comprising a means for guiding the horizontal portion of the inverted T-member between the first and second side surfaces of the clip so that the horizontal portion of the inverted T-member can be more easily attached to the clip.

19. The clip of claim 18, wherein said first and second sets of tines each comprise two pairs of tines, wherein a first pair of tines extends from a first cut-out plane and a second pair of tines extends from a second cut-out plane, said first and second pairs of tines each located on said side surfaces at the same distances from said bottom surface and are spaced longitudinally apart from each other to allow adjacent abutting ends of different stiles to be supported by a single clip, wherein all of said tines extend from their respective cut-out planes at approximately forty-five degrees to provide easy and sturdy engagement of said tines with said horizontal portion of the inverted T-member.

20. The clip of claim 19 wherein said means for guiding the horizontal portion of the inverted T-member between the first and second side surfaces of the clip, comprises first and second flanges attached to and angled outwardly from said first and second side surfaces.

21. An ornamental ceiling system that attaches to a grid network of inverted T-members, the ornamental ceiling system comprising:

(a) a clip for attaching main and cross stiles to inverted T-members;
(b) main and cross stiles each having a groove located generally-centrally and longitudinally on an upper surface of each stile, the groove further comprising:
  (1) means for engaging the clip,
  (2) first and second sidewalls located above the clip engaging means, wherein the sidewalls are substantially planar and angle outwardly and upwardly towards the upper face of the stile to provide some play for the clip; and
(c) a plurality of panels placed within openings of the grid network.

22. A clip for attaching a stile to first and second laterally extending flange portions of an inverted T-member, which comprises:

(a) a bottom surface;
(b) a stile engaging means;
(c) first and second side surfaces extending from the bottom surface;
(d) resilient means integral with the side surfaces for allowing the side surfaces to expand outwardly and contract inwardly;
(e) responsive means integral with the side surfaces responsive to a force from the laterally extending flange portions of inverted T-member for expanding side surfaces outwardly; and
(f) inverted T-member engaging means associated with the first and second side surfaces for engaging the laterally extending flange portions of the inverted T-member, wherein the inverted T-member engaging means includes first and second symmetrically opposed channels that engage the first and second laterally extending flange portions of the inverted T-member.

23. The clip of claim 22, wherein the first and second channels of the inverted T-member engaging means are spaced from the stile engaging means for such a distance that the laterally extending flange portions of the inverted T-member engage the clip above the upper surface of the stile.

* * * * *